US010240414B2

(12) United States Patent
Song et al.

(10) Patent No.: US 10,240,414 B2
(45) Date of Patent: Mar. 26, 2019

(54) REGULATING DOWNHOLE FLUID FLOW RATE USING AN MULTI-SEGMENTED FLUID CIRCULATION SYSTEM MODEL

(71) Applicant: HALLIBURTON ENERGY SERVICES, INC., Houston, TX (US)

(72) Inventors: Xingyong Song, Houston, TX (US); Jason D. Dykstra, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 65 days.

(21) Appl. No.: 15/527,667

(22) PCT Filed: Dec. 31, 2014

(86) PCT No.: PCT/US2014/073045

§ 371 (c)(1),
(2) Date: May 17, 2017

(87) PCT Pub. No.: WO2016/108907

PCT Pub. Date: Jul. 7, 2016

(65) Prior Publication Data

US 2017/0328154 A1 Nov. 16, 2017

(51) Int. Cl.
*E21B 21/06* (2006.01)
*E21B 21/08* (2006.01)
(Continued)

(52) U.S. Cl.
CPC ..... *E21B 21/08* (2013.01); *E21B 21/06* (2013.01); *E21B 31/03* (2013.01); *E21B 43/128* (2013.01); *E21B 19/166* (2013.01); *E21B 47/06* (2013.01)

(58) Field of Classification Search
CPC ..... E21B 21/06; E21B 21/08; E21B 31/03; E21B 43/128; E21B 19/166; E21B 47/06
See application file for complete search history.

(56) References Cited

U.S. PATENT DOCUMENTS 3,301,323 A 1/1967 Parsons
6,176,323 B1 1/2001 Weirich et al.
(Continued)

FOREIGN PATENT DOCUMENTS

WO 2012003101 A2 1/2012

OTHER PUBLICATIONS

International Search Report and Written Opinion; PCT Application No. PCT/US2014/073045; dated Sep. 1, 2015.
(Continued)

*Primary Examiner* — D. Andrews
*Assistant Examiner* — Dany E Akakpo
(74) *Attorney, Agent, or Firm* — Polsinelli PC

(57) ABSTRACT

A method for regulating a downhole fluid flow rate, in at least some embodiments, comprises partitioning a fluid circulation system into a sequence of segments, the sequence including a pump segment at one end and a drill bit segment at another end; obtaining a desired pressure for the drill bit segment; determining, for each of the segments in the sequence except for the drill bit segment, a desired pressure based at least in part on the desired pressure for a preceding segment in the sequence; determining a pump setting based on the desired pressure for the pump segment; and applying the pump setting to a pump used to move drilling fluid through the fluid circulation system.

17 Claims, 4 Drawing Sheets

(51) Int. Cl.

| | |
|---|---|
| ***E21B 31/03*** | (2006.01) |
| ***E21B 43/12*** | (2006.01) |
| ***E21B 19/16*** | (2006.01) |
| ***E21B 47/06*** | (2012.01) |

(56) References Cited

U.S. PATENT DOCUMENTS

| | | | | |
|---|---|---|---|---|
| 6,484,816 | B1 * | 11/2002 | Koederitz | E21B 21/08 175/25 |
| 7,055,627 | B2 | 6/2006 | Fontana et al. | |
| 7,407,019 | B2 | 8/2008 | Kinder et al. | |
| 7,836,973 | B2 | 11/2010 | Belcher et al. | |
| 7,953,586 | B2 | 5/2011 | Chen et al. | |
| 2013/0018605 | A1 * | 1/2013 | Peterson | G01F 25/0061 702/55 |

OTHER PUBLICATIONS

Kamel, Jasem M. et al.; "Modeling and Analysis of stick-slip and bit bounce in oil well drillstrings equipped with drag bits" ; Journal of Sound and Vibration 333 (2014) 6885-6899.

G C Downton, Schlumberger; SPE-170644-MS; "Systems Modeling and Design of Automated Directional Drilling Systems"; Society of Petroleum Engineers; 2014; pp. 1-26.

Qilong Xue et al.; "Study on lateral vibration of rotary steerable drilling system"; JVE International Ltd. Journal of Vibroengineering; Sep. 2014; vol. 16, Issue 6 pp. 1-11.

* cited by examiner

REGULATING DOWNHOLE FLUID FLOW RATE USING AN MULTI-SEGMENTED FLUID CIRCULATION SYSTEM MODEL

CROSS-REFERENCE TO RELATED APPLICATIONS

This application is a national stage entry of PCT/US2014/073045 filed Dec. 31, 2014, said application is expressly incorporated herein in its entirety.

BACKGROUND

Drilling fluid is used for various purposes when drilling wells. For instance, drilling fluid may be used to cool the drill bit or to flush away debris (e.g., rock cuttings) from the vicinity of the drill bit, thereby promoting drill bit longevity and optimal performance. Various factors may be considered when determining a desired flow rate for drilling fluid near the drill bit in a particular drilling environment—for example, the desired rate of penetration, mud density, and mud viscosity, among others.

Achieving the desired fluid flow rate, however, can be challenging. Fluid circulation systems that transport drilling fluid from the surface pump, to the drill bit, and back to the pump generally have variable pressure gradients, and this variability results in flow rate unpredictability. Contributing to this unpredictability are volume effects due to weight on the drill bit and torque forces that affect long drill strings (e.g., thousands of feet); these volume effects affect the pressure of fluid traveling through the drill string and, by extension, the fluid flow rate. In addition, long drill strings present delays between the time a particular speed or torque setting is applied to the pump and the time that the pump setting affects the fluid flow rate at the drill bit. Thus, controlling the pump speed and torque with the goal of achieving a desired fluid flow rate at the drill bit often produces unintended outcomes.

BRIEF DESCRIPTION OF THE DRAWINGS

Accordingly, there are disclosed in the drawings and in the following description methods and systems for regulating downhole fluid flow rate using a multi-segmented fluid circulation system model. In the drawings.

Figure 1:
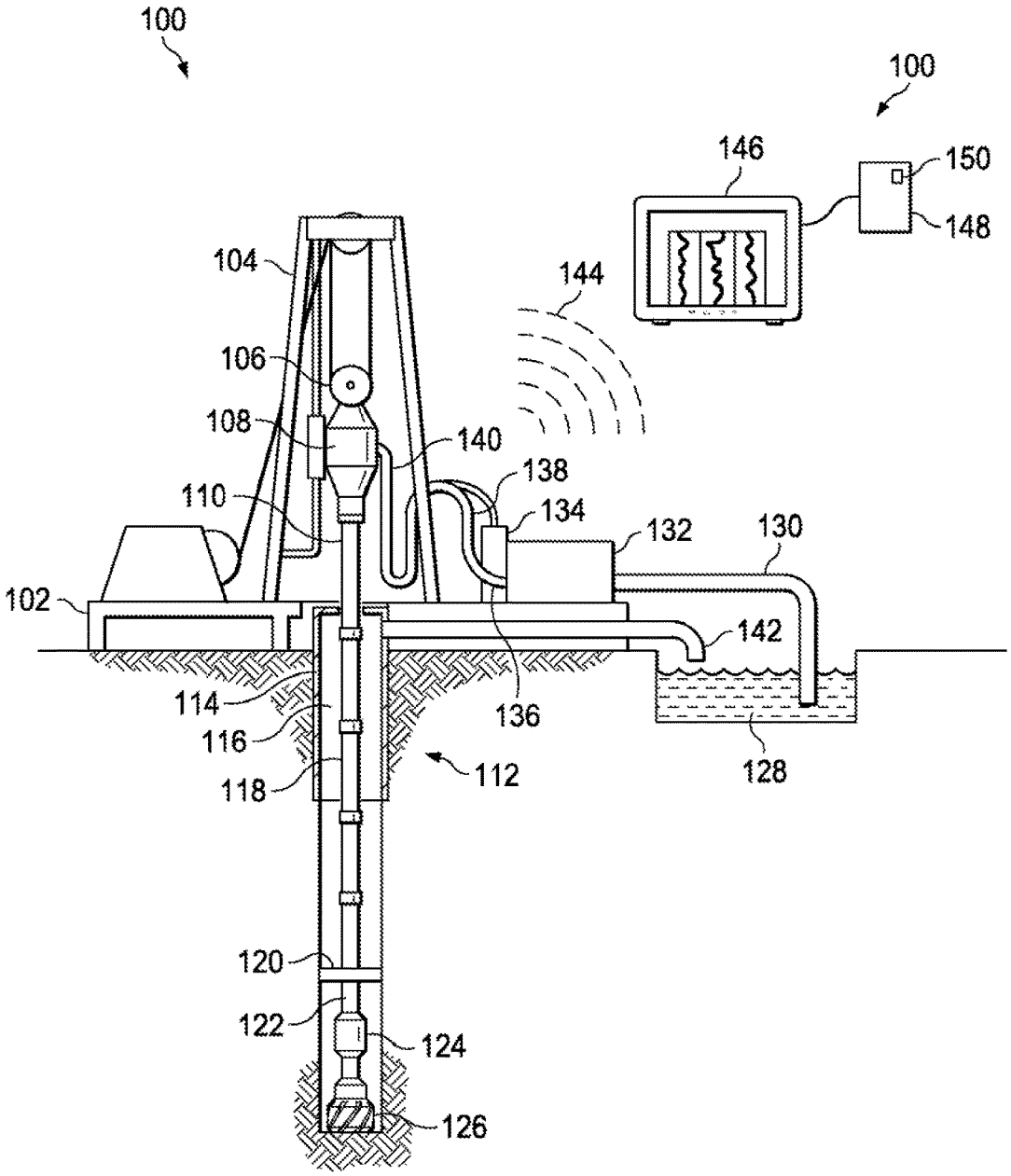
FIG. 1 is a schematic of a drilling environment.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

Disclosed herein is a technique for regulating the downhole fluid flow rate (or the rock cutting flow rate—i.e., at the drill bit) using a multi-segmented fluid circulation system model. The technique includes partitioning the fluid circulation system of a wellbore into a sequence of segments, with a pump segment at one end of the sequence, a drill bit segment at the opposing end of the sequence, and one or more segments in between. A desired fluid flow rate at the drill bit segment is identified using an appropriate fluid dynamics model of the fluid circulation system together with the drilling system mechanical dynamics model and the geo-mechanics model, and a cost function that accounts for a variety of suitable parameters (e.g., energy consumption, mud density and viscosity, desired rate of penetration). After the desired fluid flow rate at the drill bit segment has been identified, a desired pressure is determined for the drill bit segment using the desired fluid flow rate. A backstepping process is then performed in which a desired pressure is determined for each of the remaining segments in the sequence based on the desired pressure for a preceding segment in the sequence. For example, the desired pressure for the drill bit segment is used to determine the desired pressure for the segment immediately adjacent to the drill bit segment, and so on until the desired pressure for the pump segment has been identified. The pump that drives fluid through the circulation system is then adjusted so that the torque and/or speed of the pump achieves the desired pressure at the pump segment. By achieving the desired pressure at the pump segment, the desired pressure at the segment immediately adjacent to the pump segment is achieved, which in turn results in the desired pressure at the following segment being achieved, and so on. Ultimately, this "domino effect" results in the desired pressure (and, by extension, the desired fluid flow rate) being achieved at the drill bit segment. The desired pressures are continuously adjusted based on measured or estimated pressures in each segment, thus increasing the likelihood that an adjustment to torque or speed at the pump will translate to the expected fluid flow rate at the drill bit.

FIG. 1 is a schematic of an illustrative drilling environment 100. The drilling environment 100 comprises a drilling platform 102 that supports a derrick 104 having a traveling block 106 for raising and lowering a drill string 118. A top-drive motor 108 supports and turns the drill string 118 via a kelly 110 as it is lowered into a borehole 112. The drill string's rotation, alone or in combination with the operation of a downhole motor, drives the drill bit 126 to extend the borehole 112. The drill bit 126 is one component of a bottomhole assembly (BHA) 122 that may further include a rotary steering system (RSS) 124 and stabilizer 120 (or some other form of steering assembly) along with drill collars and logging instruments. While drilling, an upper portion of the borehole 112 may be stabilized with a casing string 114 while a lower portion of the borehole 112 remains open (uncased).

The drill collars in the BHA 116 are typically thick-walled steel pipe sections that provide weight and rigidity for the drilling process. The BHA 122 typically includes a navigation tool having instruments for measuring tool orientation (e.g., multi-component magnetometers and accelerometers) and a control sub with a telemetry transmitter and receiver. The control sub coordinates the operation of the various logging instruments, steering mechanisms, and drilling motors, in accordance with commands received from the surface, and provides a stream of telemetry data to the surface as needed to communicate relevant measurements and status information. A corresponding telemetry receiver and transmitter is located on or near the drilling platform 102 to complete the telemetry link. One type of telemetry link is based on modulating the flow of drilling fluid to create pressure pulses that propagate along the drill string ("mud-pulse telemetry or MPT"), but other known telemetry techniques are suitable. Much of the data obtained by the control sub may be stored in memory for later retrieval, e.g., when the BHA 122 physically returns to the surface.

A surface interface 134 serves as a hub for communicating via the telemetry link and for communicating with the various sensors and control mechanisms on the platform 102. A data processing unit 146 (shown in FIG. 1 as a tablet computer) communicates with the surface interface 134 via a wired or wireless link 144, collecting and processing measurement data to generate logs and other visual representations of the acquired data and the derived models to facilitate analysis by a user. The data processing unit may take many suitable forms, including one or more of: an embedded processor, a desktop computer, a laptop computer, a central processing facility, and a virtual computer in the cloud. In each case, software on a non-transitory information storage medium (e.g., stored within the processing unit 146) may cause the processing unit to carry out the desired processing, modeling, and display generation. The data processing unit may also contain storage to store, e.g., data received from tools in the BHA 122 via mud pulse telemetry or any other suitable communication technique. The scope of disclosure is not limited to these particular examples of data processing units.

The drilling environment 100 includes a fluid circulation system. One purpose of the fluid circulation system is to pump fluid downhole to the drill bit so that debris (e.g., rock cuttings produced by the penetration of the drill bit 126 into the formation) can be flushed away from the vicinity of the drill bit and so that the drill bit can be cooled to ensure optimal function. To this end, a pump 132 pumps drilling fluid through a pump discharge line 136, a standpipe 138, and a rotary hose 140 to the top drive 108, downhole through the interior of the kelly 110 and the drill string 118, through orifices in the drill bit 126, back to the surface via an annulus 116 around the drill string 118, through a return flow line 142, and into a retention pit 128. The drilling fluid transports formation samples—i.e., drill cuttings—from the borehole 112 into the retention pit 128 and aids in maintaining the integrity of the borehole. Formation samples may be extracted from the drilling fluid at any suitable time and location, such as from the retention pit 128. The formation samples may then be analyzed at a suitable surface-level laboratory or other facility (not specifically shown). A pump suction line 130 is used to draw fluid from the retention pit 128 to the pump 132. As the technique described herein monitors and controls the dynamics of the fluid circulation system, the technique may be encoded as software stored on storage in communication with the data processing unit 146 (e.g., within the unit 146 or as storage 148 comprising software code 150). The data processing unit 146 may control settings (e.g., torque and speed) of the pump 132 by communicating with the surface interface 134, which, in turn, controls the pump 132.

Figure 2:
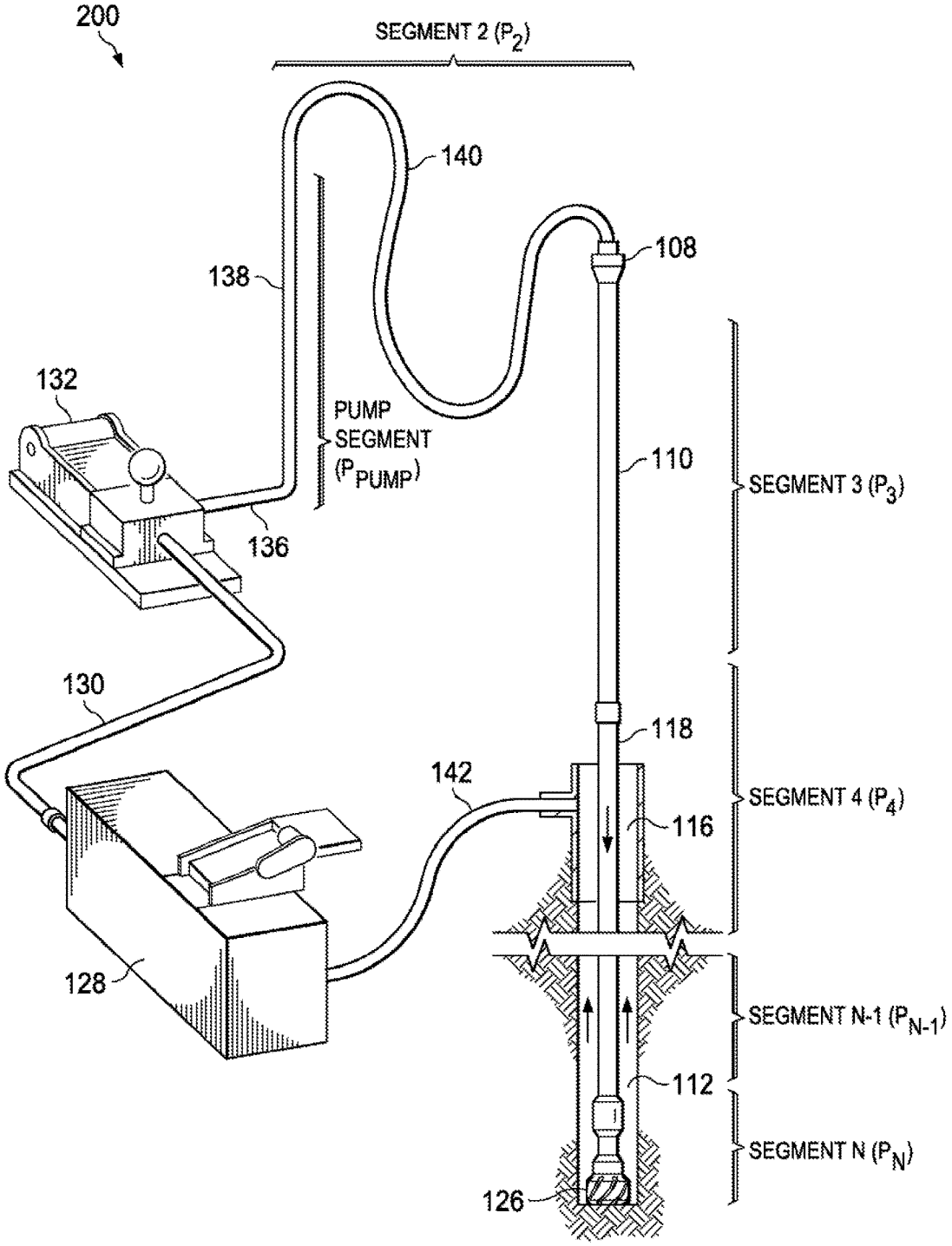
FIG. 2 is a schematic of a multi-segmented fluid circulation system.

FIG. 2 is a schematic of an illustrative, multi-segmented fluid circulation system 200, such as that used in the drilling environment 100 of FIG. 1. The fluid circulation system 200 includes the pump 132, the pump discharge line 136, the standpipe 138, the rotary hose 140, the top drive 108, the kelly 110, the drill string 118, the annulus 116 (i.e., disposed between the drill string 118 and the walls of borehole 112), the drill bit 126, the return flow line 142, the retention pit (or "mud tank") 128, and the pump suction line 130.

As shown in FIG. 2, the fluid circulation system 200 is partitioned into multiple segments labeled PUMP segment, segment 2, segment 3, segment 4, . . . , segment N−1, and segment N (i.e., the drill bit segment), with their respective pressures $P_{PUMP}$, $P_2$, $P_3$, $P_4$, . . . , $P_{N-1}$, and $P_N$ included in parentheses. The locations of the partitions are determined in any suitable manner. In some embodiments, the locations of the partitions are determined by first measuring or estimating pressures at multiple points throughout the fluid circulation system 200 to develop a pressure gradient profile for the system 200. The pressure gradient profile describes the pressures at the points selected for measurement/estimation and further describes how those pressures change throughout the course of the system 200. The pressure gradient profile is used to identify the segments of the system 200 that are most homogeneous with respect to pressure—that is, segments of the system 200 within which pressures are identical or are within a predetermined, suitable range. For instance, segments 3 and 4 may be partitioned as they are because the point at which segment 3 ends and segment 4 begins has a pressure gradient that extends beyond a suitable range. Different points within segment 3 are grouped into segment 3, however, because the measured or estimated pressures at these different points are identical or are within a suitable range. Other procedures for partitioning the fluid circulation system 200 into segments are contemplated and fall within the scope of this disclosure.

The technique disclosed herein, as applied to the fluid circulation system 200 and as described in detail with reference to FIG. 3 below, entails determining a desired fluid flow rate at the drill bit 126 (e.g., in the drill bit segment N). As explained below and as generally known to those of ordinary skill in the art, the desired fluid flow rate is determined using an appropriate fluid dynamics model (together with the drilling system mechanical dynamics model and the geo-mechanics model) of the fluid circulation system in question and a cost function to control various parameters associated with the fluid circulation system (e.g., minimization of environmental impact, minimization of the difference between the actual and desired rate of drilling penetration). After a suitable, desired fluid flow rate at the drill bit 126 has been determined, it is used to determine a desired value for pressure $P_N$. The desired value for pressure $P_N$, in turn, is used to determine the desired value for pressure $P_{N-1}$. Stated another way, a value for $P_{N-1}$ is determined that, based on the specific fluid dynamics of the fluid circulation system 200, would cause the desired value for pressure $P_N$ to be realized in the drill bit segment N, thereby causing the desired fluid flow rate to be realized in the drill bit segment N. Thus, once the desired value for pressure $P_{N-1}$ has been determined, it is used to determine the desired value for the pressure in the segment N−2 immediately adjacent to segment N−1, and this "backstepping" process is repeated for all segments until the desired value for pressure $P_{PUMP}$ in the PUMP segment has been determined. A setting (e.g., torque or speed) for the pump 132 is determined such that it would result in the realization of the desired value for $P_{PUMP}$ in the PUMP segment. The setting is applied to the pump 132, resulting in the realization of the desired value for $P_{PUMP}$ in the PUMP segment. The realization of $P_{PUMP}$ in the PUMP segment, in turn, causes the desired value for $P_2$ to be realized in segment 2. The realization of the desired value for $P_2$ in segment 2, in turn, causes the desired value for $P_3$ to be realized in segment 3, and so on, until the realization of the desired value for $P_{N-1}$ in segment N−1 causes the desired value for $P_N$ in segment N (and, by extension, the desired fluid flow rate at the drill bit 126) to be realized. To optimize accuracy, the desired values for the pressures in the various segments are regularly or continually updated based on the most recent measured or estimated actual pressure values in each of the segments. This technique is now described in greater detail with respect to FIG. 3.

Figure 3:
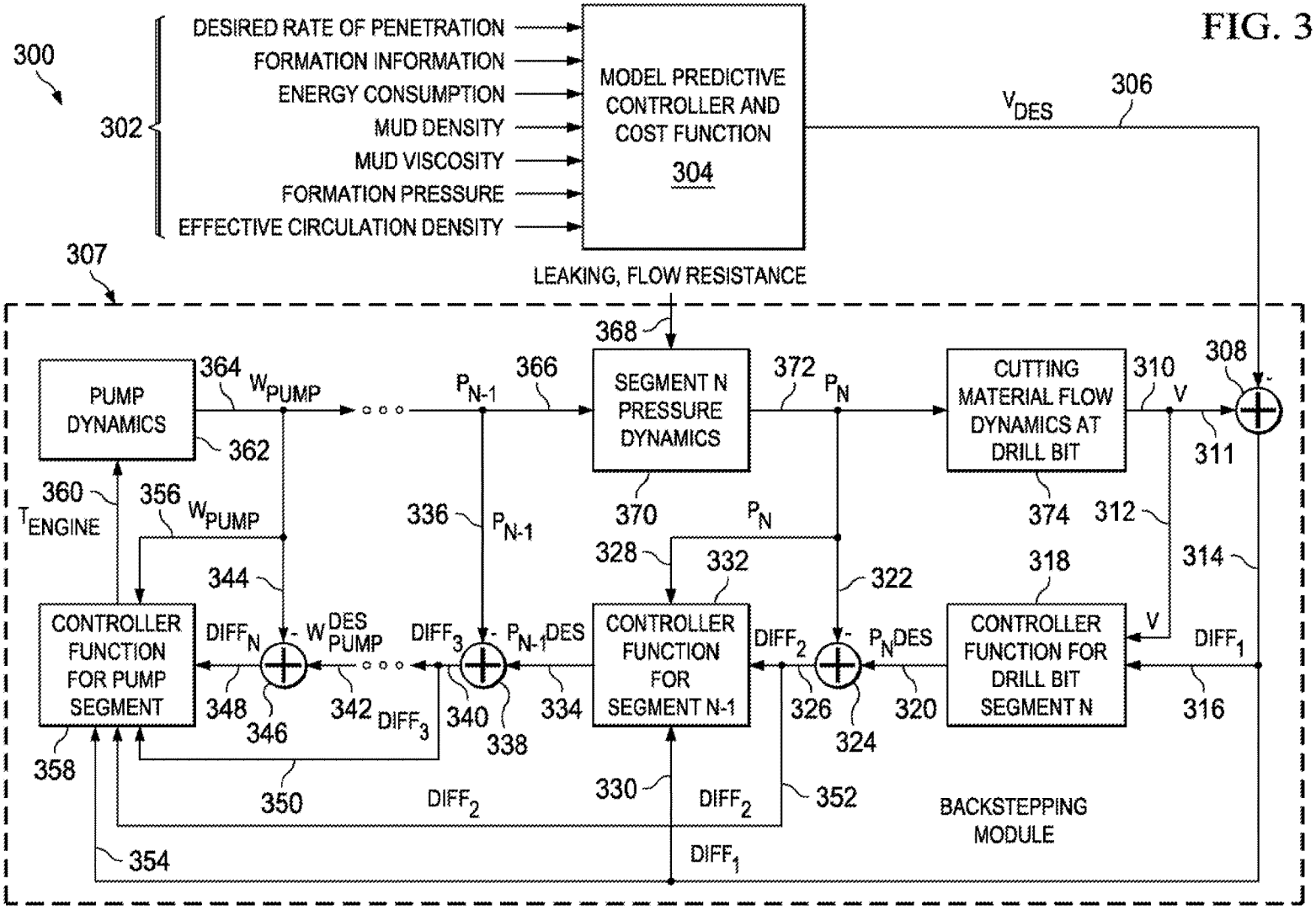
FIG. 3 is a schematic of a controller design architecture to regulate downhole fluid flow rate.

FIG. 3 is a schematic of a controller design architecture 300 to regulate the downhole fluid flow rate at the drill bit. The architecture 300 includes multiple inputs 302 to a model predictive controller and cost function module 304. The multiple inputs 302 include parameters that are useful in determining a desired fluid flow rate using a fluid dynamics model associated with the fluid circulation system 200 together with the drilling system mechanical dynamics model and the geo-mechanics model. The multiple inputs 302 also include parameters that are useful in calculating a cost function to determine the desired fluid flow rate. Illustrative inputs 302 include a desired rate of penetration of the drill bit into the formation; formation information (e.g., resistivity, permeability); energy consumption associated with the fluid circulation system 200; mud density; mud viscosity; formation pressure; and effective circulation density (ECD). The scope of disclosure is not limited to these illustrative parameters. Because the fluid dynamics model and cost function that are used in any given application of the disclosed technique may vary, the multiple input parameters also may vary, and one of ordinary skill in the art will understand how to select the multiple input parameters most conducive to determining a desired fluid flow rate using that fluid dynamics model and cost function.

These multiple inputs 302 are provided to the model predictive controller (MPC) and cost function module 304 (the term "module" as used herein broadly encompasses any type of functionality, including functionalities implemented using software, hardware/equipment, and/or human effort). The MPC is software code that evaluates a chosen fluid dynamics model of the fluid circulation system 200 in light of the multiple inputs 302. Fluid dynamics models and drilling system mechanical dynamics models vary widely between circulation and drilling systems and, therefore, MPCs vary widely as well. Illustrative fluid dynamics models are described in Kamel, Jasem et al., *Modeling and Analysis of Stick-Slip and Bit Bounce in Oil Well Drillstrings Equipped with Drag Bits*, J. Sound Vibration 2014, vol. 333 pp. 6885-6899; Xue, Oilong et al., *Study on Lateral Vibration of Rotary Steerable Drilling System*, JVE Int'l Ltd. Journal of Vibroengineering 2014, vol. 16 pp. 2702-2711; Downton, G. C., *Systems Modeling and Design of Automated Directional Drilling Systems*, Society of Petroleum Engineers Annual Technical Conference and Exhibition, Amsterdam, NL 27-29 Oct. 2014; and Chen, Chenkang et al., U.S. Pat. No. 7,953,586. The scope of disclosure is not limited to these particular models. One of ordinary skill will understand how to program a MPC to evaluate a given fluid dynamics model in light of a given set of inputs 302.

The MPC is used to determine potential values of the desired fluid flow rate at the drill bit. The field of potential fluid flow rate values may be narrowed to a single value using a cost function that is also implemented at module 304. The cost function is used to determine the single fluid flow rate that optimizes the cost function—for instance, by most closely approximating the desired rate of penetration and by minimizing energy consumption. An illustrative cost function is as follows:

$$\text{Min}[(\text{RDP}_{des}-\text{ROP})^2+(P_N V)^2+(\text{ECD}_{des}-\text{ECD})^2+(\text{Cuttingsize}_{des}-\text{Cuttingsize})^2+\text{Chemical interaction constraint}+\text{Frac gradient constraint}] \quad (1)$$

where $\text{ROP}_{des}$ is the desired rate of penetration of the drill bit into the formation, ROP is the actual rate of penetration of the drill bit into the formation, $P_N$ is the pressure at the drill bit segment, V is the flow rate at the drill bit segment (thus making the term $P_N V$ the total power applied at the drill bit), $\text{ECD}_{des}$ is the desired effective circulation density, ECD is the actual circulation density, $\text{cuttingsize}_{des}$ is the desired cutting size and cuttingsize is the actual cutting size (e.g., mean actual cutting size), "Chemical interaction constraint" reflects how the mud fluid properties (e.g., viscosity, density) change as the mud chemically interacts with the formation, and "Frac gradient constraint" is the formation fracture gradient or changing rate constraint. The cost function seeks to determine a fluid flow rate that minimizes each of the terms of the cost function. The manner in which the fluid flow rate relates to each of the cost function variables will be known to one of ordinary skill in the art. The scope of disclosure is not limited to the specific cost function provided above as equation (1). To the contrary, any suitable cost function may be used, and the precise cost function used varies between applications and drilling environments. One of ordinary skill in the art will understand how to tailor a cost function most suitable for his purposes and for his particular drilling environment.

Still referring to FIG. 3, the module 304—after having applied the multiple inputs 302 to a suitable MPC and cost function—outputs a desired fluid flow rate $V_{des}$. As numeral 306 indicates, $V_{des}$ is provided as an input to a backstepping module 307. The backstepping module 307 performs the backstepping process described above—in particular, it uses $V_{des}$ to determine a desired pressure at the drill bit segment N, and it uses the desired pressure at the drill bit segment N to determine a desired pressure at the segment N−1 immediately adjacent to the drill bit segment N such that, when realized, the desired pressure at segment N−1 would result in the realization of the desired pressure at the drill bit segment N. This process is repeated in sequential fashion until a desired pressure at the PUMP segment is determined and a corresponding pump setting (e.g., torque or speed) is identified that would result in the desired pressure at the pump segment. That setting is applied to the pump, and pressure measurements or estimations are performed to continually or periodically refine the desired pressure values for each segment.

The backstepping portion of the module 307 is generally represented by modules 318, 332 and 358, while the pressure dynamics measurement or estimation portion of the module 307 is generally represented by modules 362, 370 and 374. In general, and as explained in greater detail below, the operation of the backstepping portion of the module includes the use of a controller function for each of the segments in the fluid circulation system 200. The controller functions are represented by the modules 318, 332 and 358 and they model the fluid dynamics for a corresponding segment of the fluid circulation system 200. Accordingly, each controller function is used to determine the desired pressure for a corresponding segment based on parameters including the difference between a measured or estimated pressure for a preceding segment in the sequence and a desired pressure for the preceding segment in the sequence. In general, and as explained in further detail below, the operation of the pressure dynamics measurement or estimation portion of the module 307 entails the use of sensors to directly measure pressure at each of the segments in the fluid circulation system 200 or the mathematical estimation of the pressures using parameters including measured or estimated pressures from adjacent segments in the sequence, as indicated by modules 362, 370 and 374.

Still referring to FIG. 3, as numeral 306 indicates, the desired fluid flow rate $V_{des}$ is provided to a summation block 308 of the backstepping module 307. A current measured or estimated fluid flow rate at the drill bit also is provided to the summation block 308, as numeral 311 indicates. The summation block 308 determines the difference between the measured or estimated fluid flow rate Vat the bit and the desired fluid flow rate $V_{des}$ at the bit and outputs the difference $diff_1$, as numeral 314 indicates. As numerals 312 and 316 respectively show, V and $V_{des}$ are provided to module 318, which is a controller function representing the fluid dynamics of the drill bit segment N.

Controller functions are dependent on the dynamics of the particular fluid circulation system at issue and, therefore, they are highly variable. Generally, any function(s) or mathematical expression(s) that are able to determine a desired pressure value for a particular segment in the sequence of the fluid circulation system 200 may be suitable for use as a controller function in the illustrative modules 318, 332 and 358. An illustrative controller function for module 318 (the drill bit segment N) may be as follows:

$$P_N^{Desired} = -\frac{K_1 e_1}{A_{area}} + \frac{\text{Gravity}}{A_{area}} + \frac{\text{Well Wall Friction}}{A_{area}} + \frac{\dot{V}_{des}}{A_{area}} \quad (2)$$

where $K_1$ is a positive control gain, $e_1=V_{cuttings}-V_{des}$ and is the difference between the actual cutting velocity and the desired cutting velocity reference, Gravity is the gravity force of the cuttings, Well Wall Friction is the friction force between the cuttings and the well wall, $A_{area}$ is the wellbore cross section area, and $\dot{V}_{des}$ is the rate of change of $V_{des}$.

Controller functions, such as that shown in equation (2), may be derived in any suitable manner. In at least some embodiments, however, the controller function should be derived in a manner that ensures stability and robustness against uncertainty in input values (e.g., unusually large or small desired pressure inputs) and uncertainties in the dynamics model. To design a controller function that maintains integrity against such uncertainty, a defined Lyapunov function may be used. Lyapunov functions are well-known in the art and generally may be described in this context as nonlinear cost functions used for control design purposes. A separate Lyapunov function $L_{PUMP}, L_2, \ldots, L_i, \ldots, L_N$ may be determined for each segment in the sequence of segments that forms the fluid circulation system 200. Each pre-defined Lyapunov cost function $L_i$ must be positive definite. To determine stability for a particular controller function $C_i$ (where each segment of the fluid circulation system 200 has a separate controller function $C_{PUMP}, C_2, \ldots, C_i, \ldots C_N$), the derivative of the corresponding Lyapunov function $L_i$ must be negative definite:

$$\dot{L}_i(P_i, C_i, \Delta_i) < 0 \quad i=1,2,3, \ldots N \quad (3)$$

where $P_i$ is the derivative of a suitable pressure dynamics function for segment i, $C_i$ is the controller function for segment i, and $\Delta_i$ is the lumped uncertainty including the dynamics model uncertainty used in the control design and also the uncertainties in the fluid pressure estimation. Although pressure dynamics functions depend on the particular fluid circulation system in question, illustrative pressure dynamics functions that may be used in corresponding Lyapunov functions for stability purposes are provided in equations (6)-(8) below. An illustrative Lyapunov function corresponding to controller function module 318 is as follows:

$$L_1 = 0.5 * e_1^2 \quad (4)$$

where $e_1=V_{cuttings}-V_{des}$ and is the difference between the actual cutting velocity and the desired cutting velocity reference.

Still referring to FIG. 3, the controller function 318 outputs a desired pressure value $P_N^{des}$ for the drill bit segment N, as numeral 320 indicates. The summation block 324 determines a difference between $P_N^{des}$ and the measured or estimated value of $P_N$, which is provided to summation block 324 as indicated by numeral 322. The summation block 324 produces the difference $diff_2$ between $P_N^{des}$ and $P_N$, as numeral 326 indicates. $Diff_2$ is provided to the controller function module 332 for the segment N−1, as is $Diff_1$ (numeral 330). As numeral 328 indicates, $P_N$ also is provided to the controller function module 332. The controller function module 332 for the segment N−1, similar to the controller function module 318, employs a pressure dynamics model of the segment N−1 to determine a desired pressure $P_{N-1}^{des}$ for the segment N−1 based on the inputs provided to the module 332. As with the controller function module 318, the controller function for module 332 may vary based on the particular fluid circulation system 200 at issue. It may, however, be similar in at least some respects to the controller function for module 318, provided as equation (2) above. Likewise, it should be determined using an appropriate Lyapunov cost function to ensure stability.

The desired pressure $P_{N-1}^{des}$ is provided to the summation block 338, as indicated by numeral 334. The measured or estimated value of $P_{N-1}$ also is provided to the summation block 338, as numeral 336 indicates. The resulting difference $diff_3$, identified as numeral 340, is provided to a subsequent controller function module for segment N−2 (not specifically shown). It is also provided to the controller function modules for subsequent segments. The process shown with respect to controller function modules 318 and 332 is repeated for the controller function modules of all subsequent segments in the fluid circulation system 200. The final controller function module in the backstepping portion of the module 307 is the controller function module 358, for the pump segment. The controller function module for segment 2 (not specifically shown) outputs a desired speed for the pump $W_{pump}^{des}$, as indicated by numeral 342. The difference between $W_{pump}^{des}$ and the actual speed of the pump $W_{pump}$ (numeral 344) is determined by summation block 346, and the resulting difference $diff_N$ (segment 348) is provided as an input to the controller function module 358 for the pump segment. Other inputs provided to the controller function module 358 include the $W_{pump}$ (numeral 356), $diff_3$ (numeral 350), $diff_2$ (numeral 352), and $diff_1$ (numeral 354). Still other inputs include diff values for the controller function modules not specifically illustrated in FIG. 3—that is, the diff values corresponding to segments N−2 . . . 2 of the fluid circulation system 200.

The controller function module 358 implements a controller function that is derived in a manner similar to the controller functions described above, including the satisfaction of Lyapunov function stability requirements. The precise controller function used may vary depending on the fluid circulation system 200 in question. The controller function module 358 should be designed to output a desired torque for the pump engine $T_{engine}$, as numeral 360 indicates. The pressure measurement or estimation portion of the backstepping module 307 is now described.

The desired torque for the pump engine $T_{engine}$ is provided to the pump dynamics module 362. Module 362, like modules 370 and 374 (and additional modules for the remaining segments, which are not specifically shown), provide measured or estimated values of parameters (e.g., speed of pump and pressures at each segment) against which desired values are compared at summation blocks (e.g., summation blocks 308, 324, 338 and 346). For instance, pump dynamics module 362 outputs the actual speed of the pump $W_{pump}$, as numeral 364 indicates. The speed $W_{pump}$ is used at summation block 346 as described above to determine how far off $W_{pump}$ is from the desired value $W_{pump}^{des}$, and the resulting difference $diff_N$ is used in tandem with multiple other inputs at the controller function module 358 to determine a new value for $T_{engine}$ that will compensate for $diff_N$ and any other diff values received from other controller function modules in the backstepping portion of the module 307. The value $W_{pump}$ is also provided to the pressure dynamics module for segment 2 (not specifically shown). The process is repeated for each of the segments. For instance, when value $P_{N-1}$ is determined (numeral 366), it is compared against $P_{N-1}^{des}$ at summation block 338, as described above. It is also provided to pressure dynamics module 370 for segment N, which provides a value $P_N$ at numeral 372 using the input $P_{N-1}$ and formation leakage data as well as flow resistance data. This value $P_N$ is compared against the desired $P_N^{des}$ at summation block 324, as described above. The value $P_N$ is also provided to the cutting material flow dynamics module 374 (i.e., for the drill bit segment), which outputs the fluid flow rate value V (numeral 310). Fluid flow rate V is used as described above. In this way, the modules 362, 370 and 374, as well as other similar modules for each of the segments, are used to continually update the differences determined at the summation blocks. Updating the differences determined at the summation blocks results in continual adjustments to the desired torque for the pump engine $T_{engine}$, thereby more closely approximating the desired fluid flow rate V at the drill bit.

As mentioned above, pressure dynamics modules for each of the segments (e.g., modules 362, 370, 374) outputs either a measured or estimated value for pump speed or segment pressures. Measured values may be obtained using sensors that are placed along the fluid circulation system 200, at least one sensor for each segment in the sequence of the system 200. These sensor values are provided to the summation blocks and controller function modules as shown in the architecture 300 of FIG. 3. For example, the values $W_{pump}$, $P_{N-1}$, $P_N$ and V all may be measured values that are provided to the summation blocks 346, 338, 324, and 308, respectively. In some embodiments, however, actual measurements may not be available or it may be more desirable to use estimated values in lieu of measured values. In such cases, an observer may estimate the pressure in each segment. The observer may be a Kalman filter or an adaptive observer that takes into account variation in modeling dynamics as well as leakage into the formation and flow resistance force, which may be obtained from an online estimator or can be treated as an uncertainty term in the control design. Mathematical expressions that may be used to estimate pump speeds and pressures include:

$$I\dot{\omega}_{pump} = T_{engine} - P_{pump}Disp_{pump} \tag{5}$$

$$\dot{P}_1 = \frac{\beta}{V_1}\left[A_{orifice1}Cd\sqrt{\frac{2(P_{pump}-P_1)}{\rho}} - A_{orifice2}Cd\sqrt{\frac{2(P_1-P_2)}{\rho}}\right] + \text{other terms} \tag{6}$$

-continued $$\dot{P}_2 = \frac{\beta}{V_2}\left[A_{orifice2}Cd\sqrt{\frac{2(P_1-P_2)}{\rho}} - A_{orifice3}Cd\sqrt{\frac{2(P_2-P_3)}{\rho}}\right] + \text{other terms} \tag{7}$$

$$\dot{P}_N = \frac{\beta}{V_N}\left[A_{orificeN}Cd\sqrt{\frac{2(P_{N-1}-P_N)}{\rho}} - A_{area}V_{cuttings}\right] + \text{other terms} \tag{8}$$

$$M_{cuttings}\dot{V}_{cuttings} = A_{area} \times P_N - \text{Gravity} - \text{Well wall friction} \tag{9}$$

where $I\dot{\omega}_{pump}$ is the rate of change of pump speed; $T_{engine}$ is the torque applied to the pump engine; $P_{pump}$ is the pressure at the pump segment; $Disp_{pump}$ is the pump fluid displacement; $\dot{P}_1$, $\dot{P}_2$, and $\dot{P}_N$ are the rates of change of pressures in segments 1, 2 and N, respectively; β is the bulk modulus (i.e., compressibility of fluid); $V_1$, $V_2$, and $V_N$ are the volumes of segments 1, 2 and N, respectively; $A_{orifice1}$, $A_{orifice2}$, and $A_{orificeN}$ are the areas of the orifices to segments 1, 2 and N, respectively; Cd is the discharge coefficient; $P_{pump}$, $P_1$, $P_2$, $P_{N-1}$ and $P_N$ are pressures for segments PUMP, 1, 2, N−1 and N, respectively; ρ is mud fluid density; "other terms" includes leakage into the formation, resistance force and momentum force induced term; $A_{area}$ is wellbore cross-sectional area; $V_{cuttings}$ is the velocity of the cuttings (i.e., fluid flow rate) at the drill bit; $M_{cuttings}$ is weight of the cuttings; $\dot{V}_{cuttings}$ is the rate of change in the fluid flow rate at the drill bit; "gravity" is gravity force of the cuttings; and "well wall friction" is a value representing friction caused by the borehole wall. Equation (5) may be implemented in module 362; equations (6) and (7) may be implemented in pressure dynamics modules for segments 1 and 2, respectively; equation (8) may be implemented in module 370; and equation (9) may be implemented in module 374.

Figure 4:
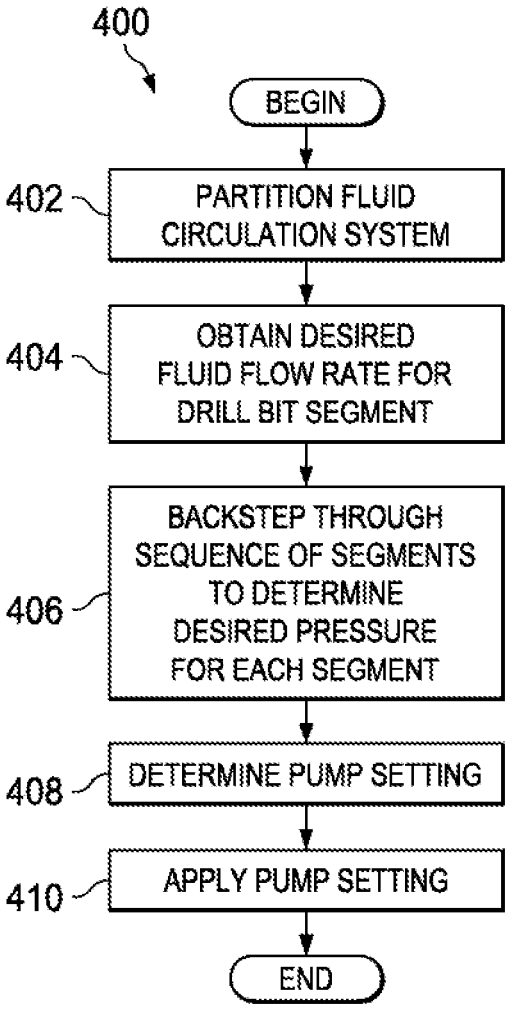
FIG. 4 is a flow diagram of a method for regulating downhole fluid flow rate using a multi-segmented fluid circulation system model.

FIG. 4 is a flow diagram of a method 400 that summarizes the backstepping technique described above. The method 400 includes partitioning the fluid circulation system into a sequence of multiple segments, with a pump segment on one end and a drill bit segment at an opposing end (step 402). The method 400 also includes obtaining a desired fluid flow rate for the drill bit segment (step 404). As explained in detail above, the desired fluid flow rate may be determined, for instance, using an appropriate model of the fluid circulation system and determining which of the possible fluid flow rates minimizes a suitable cost function. The method 400 further includes backstepping through the sequence of segments to determine the desired pressure for each segment (step 406). As explained with respect to FIG. 3, this may be accomplished by comparing a desired fluid flow rate with a measured or estimated fluid flow rate, determining a difference between the two, and using that difference to determine a desired pressure for the segment immediately adjacent to the drill bit segment (i.e., segment N−1). The desired pressure for segment N−1 is compared to the measured or estimated pressure at segment N−1 and the difference is used to determine a desired pressure for segment N−2. The process is repeated until a desired pump engine torque $T_{engine}$ is determined. The $T_{engine}$ is applied to the pump and the resulting measured or estimated pump speed and pressures in each of the segments is used to continuously refine the desired pressures in each of the segments (and, therefore, $T_{engine}$). Accordingly, the method 400 includes determining a pump setting (e.g., $T_{engine}$) (step 408) and applying that pump setting (step 410). The scope of disclosure is not limited to the precise steps and order of steps shown in FIG. 4. On the contrary, the method 400 may be modified in any suitable manner.

The present disclosure encompasses numerous embodiments. At least some of these embodiments are directed to a method for regulating a downhole fluid flow rate that comprises partitioning a fluid circulation system into a sequence of segments, the sequence including a pump segment at one end and a drill bit segment at another end; obtaining a desired pressure for the drill bit segment; determining, for each of the segments in the sequence except for the drill bit segment, a desired pressure based at least in part on the desired pressure for a preceding segment in the sequence; determining a pump setting based on the desired pressure for the pump segment; and applying the pump setting to a pump used to move drilling fluid through the fluid circulation system. Such embodiments may be supplemented in a variety of ways, including by adding any of the following concepts or steps in any sequence and in any combination: further comprising obtaining and using a desired fluid flow rate for the drill bit segment to obtain the desired pressure for the drill bit segment, wherein obtaining the desired fluid flow rate for the drill bit segment comprises using a cost function that accounts for multiple parameters associated with the fluid circulation system; wherein said multiple parameters are selected from the group consisting of: drilling mud density, drilling mud viscosity, desired rate of penetration, effective circulation density, energy consumption, and formation pressure; wherein obtaining the desired pressure for the drill bit segment comprises using a desired fluid flow rate for the drill bit segment and a measured or estimated fluid flow rate for the drill bit segment; wherein obtaining the desired pressure for the drill bit segment comprises using a difference between a measured or estimated fluid flow rate for the drill bit segment and a desired fluid flow rate for the drill bit segment; wherein using said difference includes using a controller function:

$$P_N^{Desired} = -\frac{K_1 e_1}{A_{area}} + \frac{\text{Gravity}}{A_{area}} + \frac{\text{Well Wall Friction}}{A_{area}} + \frac{\dot{V}_{des}}{A_{area}}$$

wherein $K_1$ is a positive control gain, $e_1=V_{cuttings}-V_{des}$ and is a difference between an actual cutting velocity and a desired cutting velocity reference, Gravity is a gravity force of cuttings, Well Wall Friction is a friction force between cuttings and a well wall, $A_{area}$ is a wellbore cross section area, and $\dot{V}_{des}$ is a rate of change of $V_{des}$; further comprising determining the controller function using a Lyapunov function $L_1=0.5*e_1^2$ such that a derivative of the Lyapunov function is negative definite to ensure stability of the controller function; further comprising determining said estimated fluid flow rate for the drill bit segment using the desired pressure for the drill bit segment and a desired pressure of a segment immediately adjacent to the drill bit segment in said sequence; wherein said pump setting comprises pump torque.

At least some embodiments are directed to a system comprising storage having software code which, when executed by a processor, causes the processor to: partition a fluid circulation system into a sequence of segments, said sequence including a pump segment at one end and a drill bit segment at another end; determine a desired pressure for the drill bit segment using a desired fluid flow rate for the drill bit segment; determine, for each of the segments in the sequence except for the drill bit segment, a desired pressure based at least in part on the desired pressure for a preceding segment in the sequence; and operate a pump to move drilling fluid through said fluid circulation system based on the desired pressure for the pump segment. Such embodiments may be supplemented in a variety of ways, including by adding any of the following concepts in any sequence and in any combination: wherein the desired pressure for each of the segments in the sequence except for the drill bit segment is determined using a difference between the desired pressure for a preceding segment in the sequence and a measured or estimated pressure associated with said preceding segment; wherein said desired pressure for each of the segments in the sequence except for the drill bit segment is determined using a difference between the desired pressure for another preceding segment in the sequence and another measured or estimated pressure associated with said another preceding segment; wherein said desired pressure for the drill bit segment is determined using a controller function that accounts for a difference between the desired fluid flow rate for the drill bit segment and a measured or estimated fluid flow rate for the drill bit segment, and wherein the controller function further accounts for a rate of change of said difference; wherein said desired pressure for the drill bit segment is determined using a controller function:

$$P_N^{Desired} = -\frac{K_1 e_1}{A_{area}} + \frac{\text{Gravity}}{A_{area}} + \frac{\text{Well Wall Friction}}{A_{area}} + \frac{\dot{V}_{des}}{A_{area}}$$

wherein $K_1$ is a positive control gain, $e_1=V_{cuttings}-V_{des}$ and is a difference between an actual cutting velocity and a desired cutting velocity reference, Gravity is a gravity force of cuttings, Well Wall Friction is a friction force between cuttings and a well wall, $A_{area}$ is a wellbore cross section area, and $\dot{V}_{des}$ is a rate of change of $V_{des}$; and wherein operating the pump based on the desired pressure for the pump segment comprises determining a torque or speed at which said pump is to be operated based on the desired pressure for the pump segment.

Yet other embodiments are directed to a method for controlling the fluid flow rate of a fluid circulation system at a drill bit, comprising: obtaining a desired fluid flow rate at the drill bit; determining, in sequential fashion, a desired fluid pressure for each of a plurality of segments of the fluid circulation system, wherein a desired fluid pressure for a drill bit segment is determined based on the desired fluid flow rate at the drill bit; and operating a pump to move drilling fluid through the fluid circulation system based on the desired pressure for a pump segment of the fluid circulation system. Such embodiments may be supplemented in a variety of ways, including by adding any of the following concepts or steps in any sequence and in any combination: wherein determining said desired fluid pressures in sequential fashion includes determining the desired fluid pressures for a drill bit segment first and for said pump segment last; wherein determining the desired fluid pressure for the drill bit segment comprises using a controller function that accounts for a difference between the desired fluid flow rate at the drill bit and a measured or estimated fluid flow rate at the drill bit, and wherein the controller function further accounts for a rate of change of said difference; wherein determining the desired fluid pressure for each of the plurality of segments except for the drill bit segment comprises using a difference between a desired pressure for a different segment and an actual or estimated pressure for said different segment; and further comprising determining said estimated pressure for the different segment using desired pressures for segments immediately adjacent to the different segment.

The following is claimed:

1. A method for regulating a downhole fluid flow rate, comprising:

partitioning a fluid circulation system into a sequence of segments, said sequence including a pump segment at one end and a drill bit segment at another end;

obtaining a desired pressure for the drill bit segment using a difference between a measured or estimated fluid flow rate for the drill bit segment and a desired fluid flow rate for the drill bit segment, the difference includes using a controller function:

$$P_N^{Desired} = -\frac{K_1 e_1}{A_{area}} + \frac{\text{Gravity}}{A_{area}} + \frac{\text{Well Wall Friction}}{A_{area}} + \frac{\dot{V}_{des}}{A_{area}}$$

wherein $K_1$ is a positive control gain, $e_1=V_{cuttings}-V_{des}$ and is a difference between an actual cutting velocity and a desired cutting velocity reference, Gravity is a gravity force of cuttings, Well Wall Friction is a friction force between cuttings and a well wall, $A_{area}$ is a wellbore cross section area, and $\dot{V}_{des}$ is a rate of change of $V_{des}$;

determining, for each of the segments in the sequence except for the drill bit segment, a desired pressure based at least in part on the desired pressure for a preceding segment in the sequence;

determining a pump setting based on the desired pressure for the pump segment; and applying the pump setting to a pump used to move drilling fluid through the fluid circulation system.

2. The method of claim 1, further comprising obtaining and using a desired fluid flow rate for the drill bit segment to obtain the desired pressure for the drill bit segment, wherein obtaining the desired fluid flow rate for the drill bit segment comprises using a cost function that accounts for multiple parameters associated with the fluid circulation system.

3. The method of claim 2, wherein said multiple parameters are selected from the group consisting of: drilling mud density, drilling mud viscosity, desired rate of penetration, effective circulation density, energy consumption, and formation pressure.

4. The method of claim 1, wherein obtaining the desired pressure for the drill bit segment comprises using a desired fluid flow rate for the drill bit segment and a measured or estimated fluid flow rate for the drill bit segment.

5. The method of claim 1, further comprising determining the controller function using a Lyapunov function $L_1=0.5*e_1^2$ such that a derivative of the Lyapunov function is negative definite to ensure stability of the controller function.

6. The method of claim 1, further comprising determining said estimated fluid flow rate for the drill bit segment using the desired pressure for the drill bit segment and a desired pressure of a segment immediately adjacent to the drill bit segment in said sequence.

7. The method of claim 1, wherein said pump setting comprises pump torque.

8. A system comprising storage having software code which, when executed by a processor, causes the processor to:

partition a fluid circulation system into a sequence of segments, said sequence including a pump segment at one end and a drill bit segment at another end;

determine a desired pressure for the drill bit segment using a desired fluid flow rate for the drill bit segment using a controller function:

$$P_N^{Desired} = -\frac{K_1 e_1}{A_{area}} + \frac{\text{Gravity}}{A_{area}} + \frac{\text{Well Wall Friction}}{A_{area}} + \frac{\dot{V}_{des}}{A_{area}}$$

wherein $K_1$ is a positive control gain, $e_1=V_{cuttings}-V_{des}$ and is a difference between an actual cutting velocity and a desired cutting velocity reference, Gravity is a gravity force of cuttings, Well Wall Friction is a friction force between cuttings and a well wall, $A_{area}$ is a wellbore cross section area, and $\dot{V}_{des}$ is a rate of change of $V_{des}$;

determine, for each of the segments in the sequence except for the drill bit segment, a desired pressure based at least in part on the desired pressure for a preceding segment in the sequence; and operate a pump to move drilling fluid through said fluid circulation system based on the desired pressure for the pump segment.

9. The system of claim 8, wherein the desired pressure for each of the segments in the sequence except for the drill bit segment is determined using a difference between the desired pressure for a preceding segment in the sequence and a measured or estimated pressure associated with said preceding segment.

10. The system of claim 9, wherein said desired pressure for each of the segments in the sequence except for the drill bit segment is determined using a difference between the desired pressure for another preceding segment in the sequence and another measured or estimated pressure associated with said another preceding segment.

11. The system of 10, wherein said desired pressure for the drill bit segment is determined using a controller function that accounts for a difference between the desired fluid flow rate for the drill bit segment and a measured or estimated fluid flow rate for the drill bit segment, and wherein the controller function further accounts for a rate of change of said difference.

12. The system of claim 8, wherein operating the pump based on the desired pressure for the pump segment comprises determining a torque or speed at which said pump is to be operated based on the desired pressure for the pump segment.

13. A method for controlling the fluid flow rate of a fluid circulation system at a drill bit, comprising:

obtaining a desired fluid flow rate at the drill bit;

determining, in sequential fashion, a desired fluid pressure for each of a plurality of segments of the fluid circulation system, wherein a desired fluid pressure for a drill bit segment is determined based on the desired fluid flow rate at the drill bit using a controller function:

$$P_N^{Desired} = -\frac{K_1 e_1}{A_{area}} + \frac{\text{Gravity}}{A_{area}} + \frac{\text{Well Wall Friction}}{A_{area}} + \frac{\dot{V}_{des}}{A_{area}}$$

wherein $K_1$ is a positive control gain, $e_1=V_{cuttings}-V_{des}$ and is a difference between an actual cutting velocity and a desired cutting velocity reference, Gravity is a gravity force of cuttings, Well Wall Friction is a friction force between cuttings and a well wall, $A_{area}$ is a wellbore cross section area, and $\dot{V}_{des}$ is a rate of change of $V_{des}$; and operating a pump to move drilling fluid through the fluid circulation system based on the desired pressure for a pump segment of the fluid circulation system.

14. The method of claim 13, wherein determining said desired fluid pressures in sequential fashion includes determining the desired fluid pressures for a drill bit segment first and for said pump segment last.

15. The method of claim 13, wherein determining the desired fluid pressure for the drill bit segment comprises using a controller function that accounts for a difference between the desired fluid flow rate at the drill bit and a measured or estimated fluid flow rate at the drill bit, and wherein the controller function further accounts for a rate of change of said difference.

16. The method of claim 13, wherein determining the desired fluid pressure for each of the plurality of segments except for the drill bit segment comprises using a difference between a desired pressure for a different segment and an actual or estimated pressure for said different segment.

17. The method of claim 16, further comprising determining said estimated pressure for the different segment using desired pressures for segments immediately adjacent to the different segment.

* * * * *